US011585207B2

(12) United States Patent
Al-Qasim

(10) Patent No.: US 11,585,207 B2
(45) Date of Patent: Feb. 21, 2023

(54) ADVANCED RAPID LOGGING SYSTEM

(71) Applicant: SAUDI ARABIAN OIL COMPANY, Dhahran (SA)

(72) Inventor: Abdulaziz S. Al-Qasim, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 16 days.

(21) Appl. No.: 17/198,809

(22) Filed: Mar. 11, 2021

(65) Prior Publication Data

US 2022/0290534 A1 Sep. 15, 2022

(51) Int. Cl.

| | |
|---|---|
| ***E21B 47/01*** | (2012.01) |
| ***E21B 23/00*** | (2006.01) |
| *E21B 43/12* | (2006.01) |

(52) U.S. Cl.

CPC ..... *E21B 47/01* (2013.01); *E21B 23/00* (2013.01); *E21B 23/001* (2020.05); *E21B 43/121* (2013.01)

(58) Field of Classification Search

CPC ..... E21B 47/01; E21B 23/00; E21B 23/001; E21B 41/0085; E21B 43/121

See application file for complete search history.

(56) References Cited

U.S. PATENT DOCUMENTS

| | | | | |
|---|---|---|---|---|
| 3,404,638 | A | 10/1968 | Edwards | |
| 3,508,497 | A | 4/1970 | Matsukata | |
| 4,075,948 | A | 2/1978 | Minovitch | |
| 5,947,213 | A | 9/1999 | Angle et al. | |
| 6,378,627 | B1 * | 4/2002 | Tubel | E21B 47/00 166/255.2 |
| 6,510,898 | B1 * | 1/2003 | Buytaert | E21B 47/09 166/240 |
| 2007/0231072 | A1 | 10/2007 | Jennings et al. | |
| 2010/0132955 | A1 * | 6/2010 | Storm, Jr | E21B 23/02 166/243 |
| 2014/0262219 | A1 * | 9/2014 | Beddoes | E21B 43/30 175/57 |

(Continued)

FOREIGN PATENT DOCUMENTS

| | | | |
|---|---|---|---|
| CN | 108104878 | A | 6/2018 |
| CN | 108661567 | B | 12/2019 |

(Continued)

OTHER PUBLICATIONS

"Modelling of pneumatic suspensions", UCLouvain, Access Date: Mar. 10, 2021, URL: <https://uclouvain.be/en/research-institutes/immc/modelling-of-pneumatic-suspensions.html> (5 pages).

(Continued)

*Primary Examiner* — Brad Harcourt

(74) *Attorney, Agent, or Firm* — Osha Bergman Watanabe & Burton LLP

(57) ABSTRACT

A logging system for a tubular includes: a rail system comprising a plurality of rails and mounted to a surface of the tubular; a logging tool carrier connected to the rail system; and a logging tool disposed on the logging tool carrier. The logging tool is deployed on the logging tool carrier connected to the rail system along the tubular to a targeted position along the tubular and then retrieved from the wellbore. During deployment of the logging tool, the logging tool acquires a plurality of logging data.

18 Claims, 9 Drawing Sheets

(56) References Cited

U.S. PATENT DOCUMENTS

| | | | | |
|---|---|---|---|---|
| 2014/0262340 | A1* | 9/2014 | Beddoes | E21C 41/24 175/57 |
| 2016/0230350 | A1 | 8/2016 | Bambrogan et al. | |
| 2018/0073560 | A1 | 3/2018 | Karpetis et al. | |

FOREIGN PATENT DOCUMENTS

| | | | |
|---|---|---|---|
| CN | 111795255 | A | 10/2020 |
| DE | 4114183 | A1 | 11/1992 |
| DE | 102005032710 | A1 | 1/2007 |

OTHER PUBLICATIONS

"Vehicles—From the prototype to the modern suspension railway", Schwebebahn, Access Date: Mar. 10, 2021, URL:<https://www.schwebebahn.de/en/history-technology/vehicles/> (7 pages).

International Search Report and Written Opinion issued in Application No. PCT/US2022/020009, dated May 11, 2022 (12 pages).

* cited by examiner

ADVANCED RAPID LOGGING SYSTEM

BACKGROUND

Hydrocarbon resources are typically located below the earth's surface in subterranean porous frock formations, often called reservoirs. These hydrocarbon bearing reservoirs can be found in depths of tens of thousands of feet below the surface. In order to extract the hydrocarbon fluids, also referred to as oil and/or gas, wells may be drilled to gain access to the reservoirs. Wells may be drilled vertically from surface, deviated from vertical, or vertical to horizontal in order to most effectively and efficiently access the subsurface hydrocarbon reservoirs. Wells may be cased to protect the integrity of the Well. This is achieved by cementing tubulars in place isolating the internal conduit or well from the surrounding formations, which may be prone to collapse.

Wellbore logging is an important operation that may be conducted at any point throughout the life of a well and is primarily used to acquire important data about formation, integrity of the wellbore, or production characteristics. Wellbore logging is performed by a logging tool that is deployed into the wellbore and may have a variety of sensors to measure a plurality of parameters including, but not limited to, depth, wear, resistivity, water content, porosity, and permeability. During the drilling phase, logging operations are typically completed after each new segment of well is drilled and are primarily focused on formation evaluation. During the production phase, logging operations may be conducted at any time and are typically focused on integrity and production.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to.

In one or more embodiments, the present invention relates to a logging system for a tubular, comprising: a rail system comprising a plurality of rails and mounted to a surface of the tubular; a logging tool carrier connected to the rail system; and a logging tool disposed on the logging tool carrier; wherein the logging tool is deployed on the logging tool carrier connected to the rail system along the tubular to a targeted position along the tubular and then retrieved from the wellbore; wherein, during deployment of the logging tool, the logging tool acquires a plurality of logging data.

In one or more embodiments, the present invention relates to a method of logging a tubular, comprising: mounting a rail system within an inside diameter surface of a tubular integrated into the tubular; disposing a logging tool onto a logging tool carrier, connecting the logging tool carrier to the rail system; deploying the logging tool carrier from a deployment position on the rail system inside the tubular, wherein the rail system guides the logging tool carrier to a targeted point along the tubular; retrieving the logging tool carrier via the rail system along the tubular, wherein rail system guides the return of the logging tool carrier to the deployment position; and acquiring, via the logging tool while deployed, a plurality of logging data.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
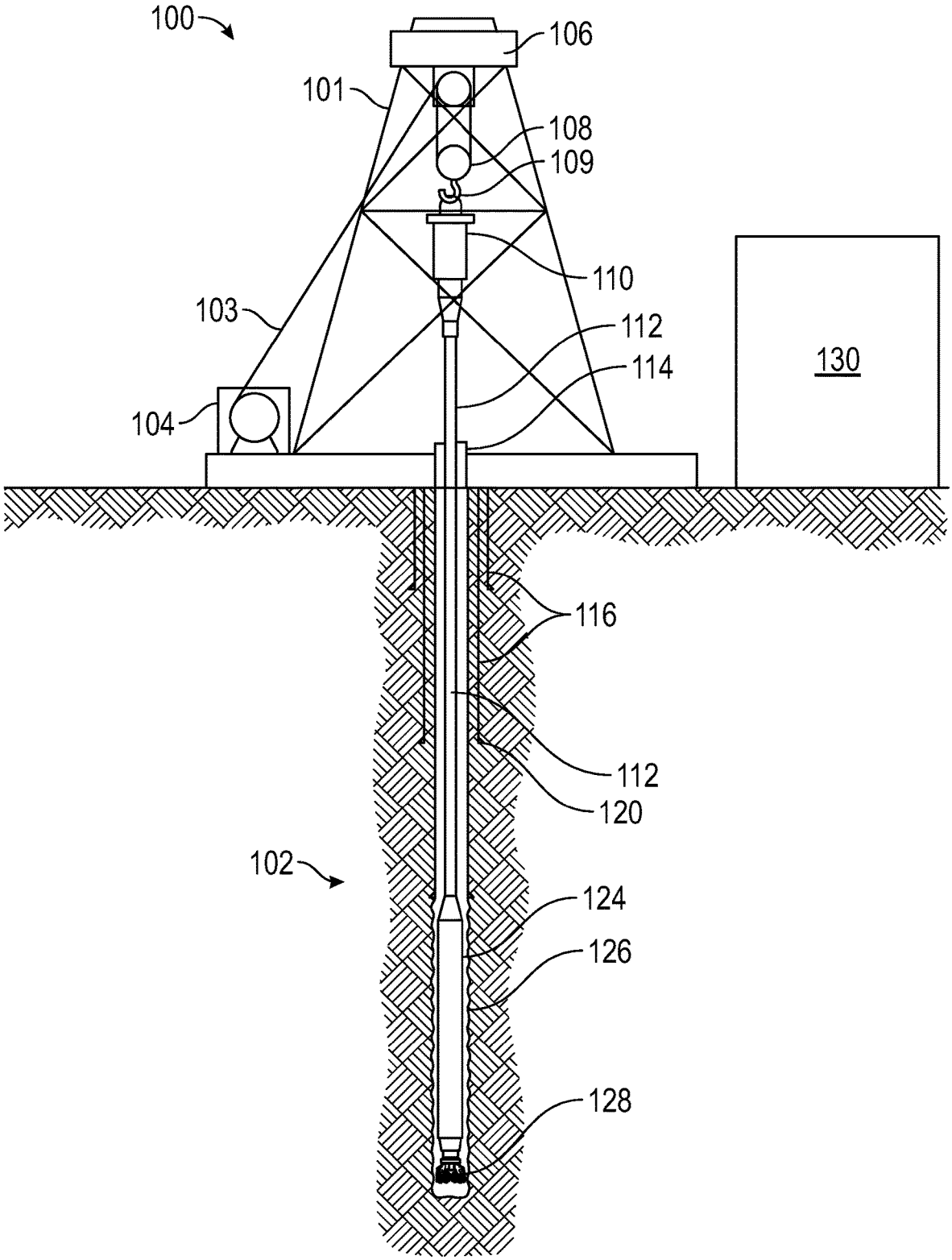
FIG. 1 is a schematic showing a generic drilling rig and wellbore.

FIG. 1 illustrates an exemplary well site (100). In general, well sites may be configured in a myriad of ways. Therefore, well site (100) is not intended to be limiting with respect to the particular configuration of the drilling equipment. The well site (100) is depicted as being on land. In other examples, the well site (100) may be offshore, and drilling may be carried out with or without use of a marine riser. A drilling operation at well site (100) may include drilling a wellbore (102) into a subsurface including various formations (126). For the purpose of drilling a new section of wellbore (102), a drill string (112) is suspended within the wellbore (102). The drill string (112) may include one or more drill pipes connected to form conduit and a bottom hole assembly (BHA) (124) disposed at the distal end of the conduit. The BHA (124) may include a drill bit (128) to cut into the subsurface rock. The BHA (124) may include measurement tools, such as measurement-while-drilling (MWD) tool and logging-while-drilling (LWD) tool (not shown), as well as other drilling tools that are not specifically shown.

The drill string (112) may be suspended in wellbore (102) by a derrick structure (101). A crown block (106) may be mounted at the top of the derrick structure (101), and a traveling block (108) may hang down from the crown block (106) by means of a cable or drilling line (103). One end of the drill line (103) may be connected to a drawworks (104), which is a reeling device that can be used to adjust the length of the cable (103) so that the traveling block (108) may move up or down the derrick structure (101). The traveling block (108) may include a hook (109) on which a top drive (110) is supported. The top drive (110) is coupled to the top of the drill string (112) and is operable to rotate the drill string (112). Alternatively, the drill string (112) may be rotated by means of a rotary table (not shown) at the surface (114). Drilling fluid (commonly called mud) (130) may pump the mud from the mud pit (not shown) into the drill string (112). The mud may flow into the drill string (112) through appropriate flow paths in the top drive (110) (or a rotary swivel if a rotary table is used instead of a top drive to rotate the drill string (not shown)).

During a drilling operation at the well site (100), the drill string (112) is rotated relative to the wellbore (102), and weight is applied to the drill bit (128) to enable the drill bit (128) to break rock as the drill string (112) is rotated. In some cases, the drill bit (128) may be rotated independently with a drilling motor (not shown). In further embodiments, the drill bit (128) may be rotated using a combination of the drilling motor (not shown) and the top drive (110) (or a rotary swivel if a rotary table is used instead of a top drive to rotate the drill string (112)). While cutting rock with the drill bit (128), mud is pumped into the drill string (112). The mud flows down the drill string (112) and exits into the bottom of the wellbore (102) through nozzles in the drill bit (128). The mud in the wellbore (102) then flows back up to the surface in an annular space between the drill string (112) and the wellbore (102) with entrained cuttings. The mud with the cuttings is returned to the pit (130) to be circulated back again into the drill string (112). Typically, the cuttings are removed from the mud, and the mud is reconditioned as necessary, before pumping the mud again into the drill string (112).

Post drilling operations, when the drill string (112), the BHA (124), and the drill bit (128) have been removed from the wellbore (102), in some embodiments of wellbore (102) construction, the casing operations may commence. A casing string (116), which is made up of one or more lager diameter tubulars that have a larger outer diameter than the drill string (112) but a smaller outer diameter than the wellbore (102), are lowered into the wellbore (102) on the drill string (112). In some embodiments, the casing string (116) is designed to isolate the internal diameter of the wellbore (102) from the adjacent formation (126). Once the casing string (116) is in position, it is set and cement is pumped down through the internal space of the casing string (116), out of the bottom of the casing shoe (120), and fills the annular space between the wellbore (102) and the outer diameter of the casing string (116). This secures the casing string in place and creates the desired isolation between the wellbore (102) and the formation (126). At this point, drilling of the next section of the wellbore (102) may commence.

Figure 2A:
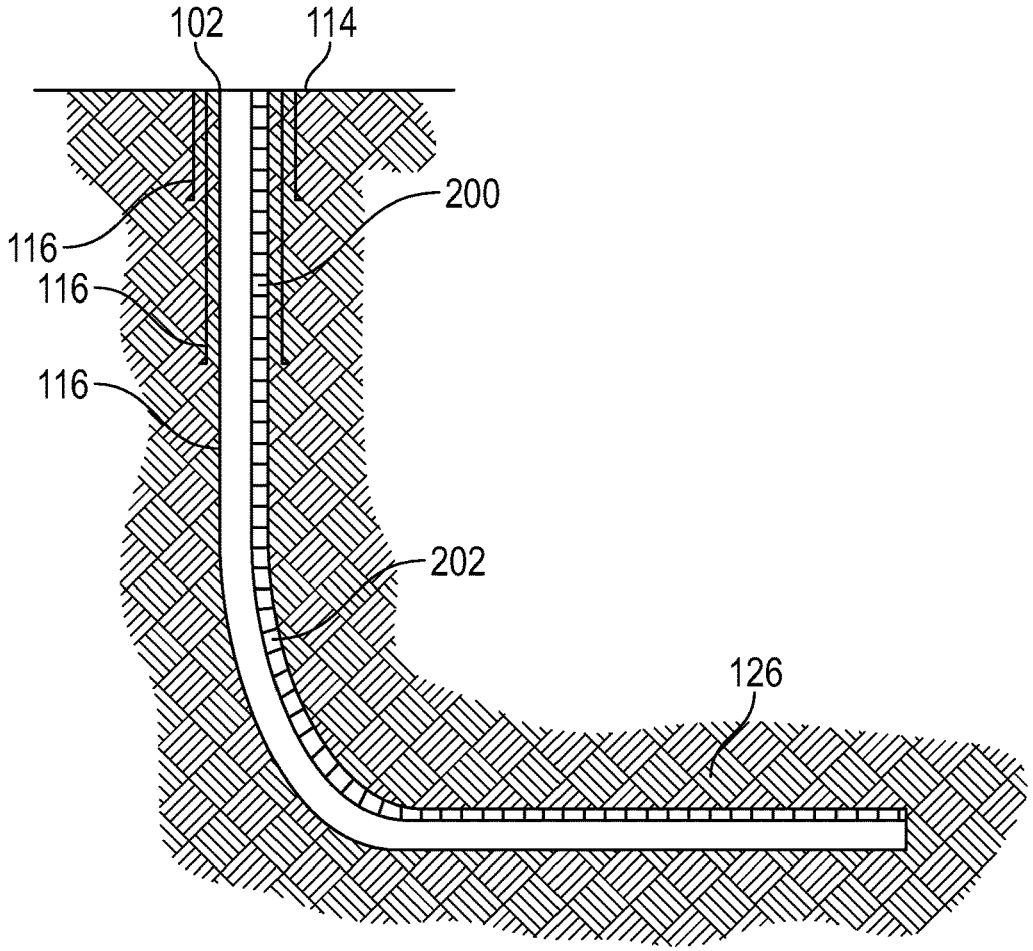
FIG. 2A is a schematic showing the Single Rail Track System in accordance with one or more embodiments.

FIG. 2A depicts, in one or more embodiments, a proposed layout of a wellbore (102) with an integrated single rail system (200). The single rail system (200) consists of a plurality of single rail sections (202) fitted end to end and that may be of a standard head, web, and foot design, a grooved rail design, or a design that one of ordinary skill would appreciate. In addition, the single rail system (200) is constructed from steel alloy or equivalent. Extending from the surface (114) to the distal end of the wellbore (102), the single rail system (200) is connected to the internal surface of the casing (116). In addition, the single rail system (200) provides a physical track that attaches to, and guides, the single track logging tool carrier (300) from surface (114) to the bottom location of the wellbore (102). In one or more embodiments, the single rail system (200) may be disposed to the outside diameter of the casing (116) or pipeline (not shown).

Figure 2B:
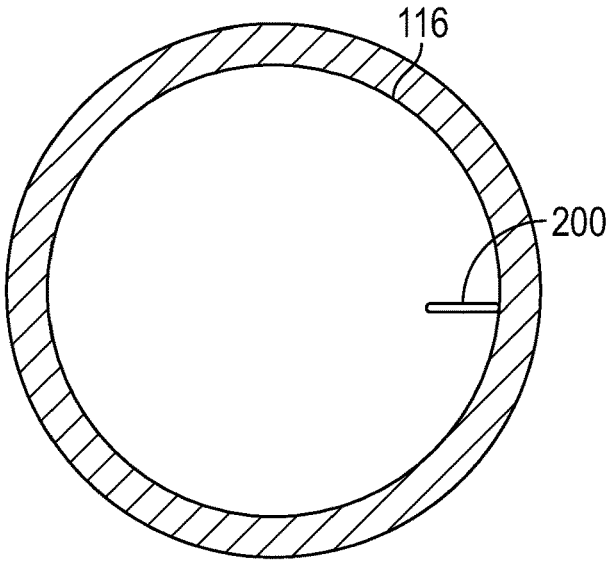
FIG. 2B is a schematic showing top view of the Single Rail Track System in accordance with one or more embodiments.

FIG. 2B depicts, in one or more embodiments, the top view of the wellbore (102) from FIG. 2A with the single rail system (200) mounted to the internal surface of the casing (116). Those skilled in the art will appreciate that in other embodiments the single rail system (200) may be attached to the outside of the casing (116).

Figure 2C:
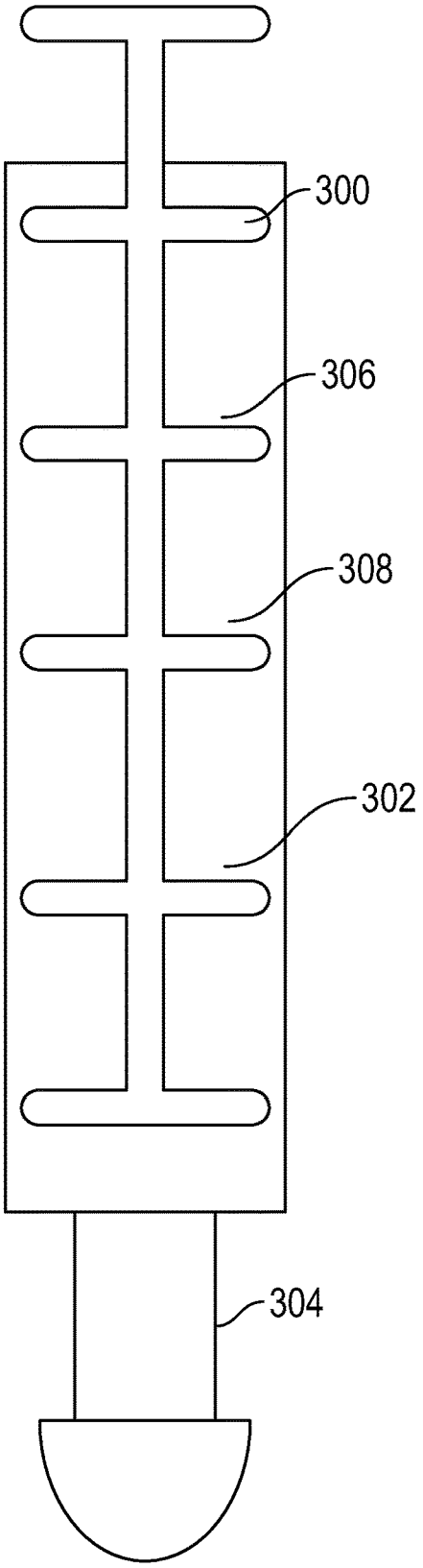
FIG. 2C is a schematic showing the Single Rail Track System Logging Tool in accordance with one or more embodiments.

FIG. 2C depicts, in one or more embodiments, a logging tool (302) attached to single rail logging tool carrier (300). The logging tool (302) consists of a plurality of logging sensors (304) disposed at the front, with a power source (306) and an inlet fan (308) disposed near the back. The logging sensors (304) are used to measure an array of subsurface parameters including, but not limited to, depth, wear, resistivity, water content, porosity, and permeability. The power source (306) may be at least one of electric powered and battery powered. The inlet fan (308) is utilized to navigate the wellbore (102), which may have a complex trajectory. The logging tool (302) is attached to the single rail logging tool carrier (300), which consists of a non-corrosive material. The single rail logging tool carrier (300) is mounted to the single rail system (200) and configured to operatively traverse the wellbore (102) as required.

Figure 3A:
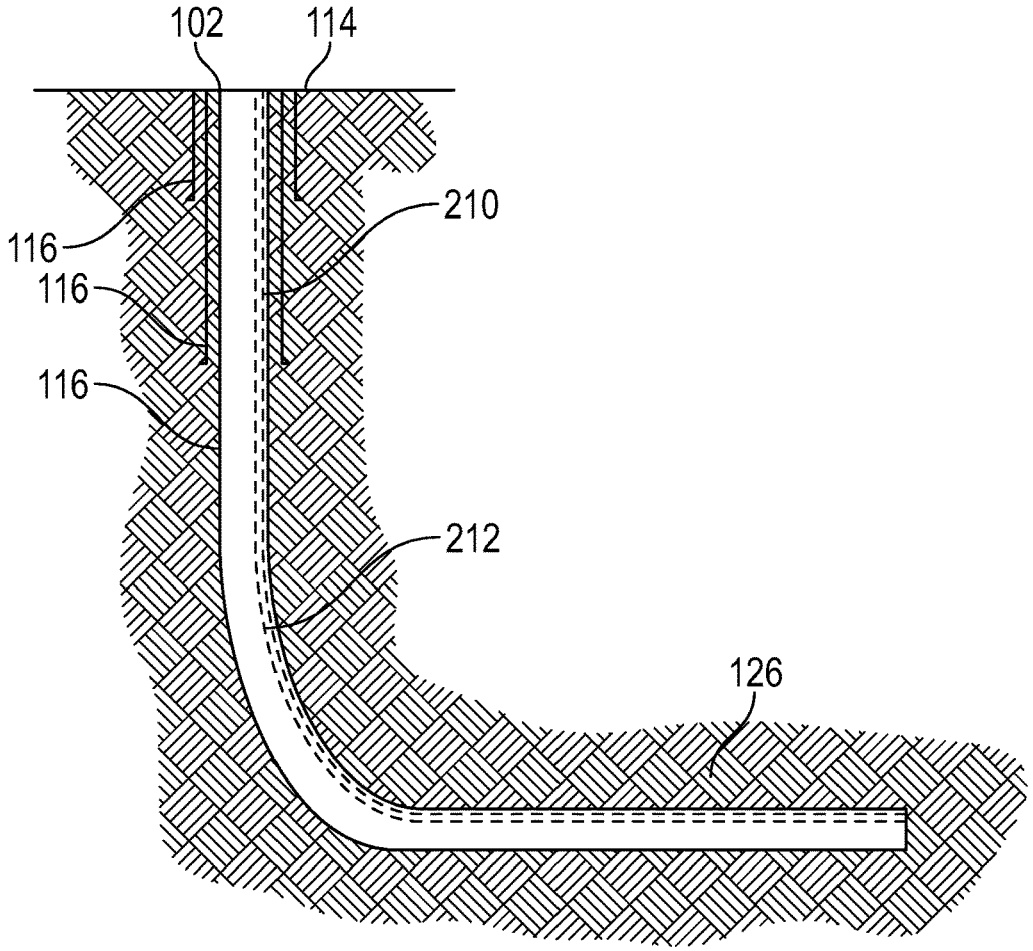
FIG. 3A is a schematic showing the Double Rail Track System in accordance with one or more embodiments.

FIG. 3A depicts, in one or more embodiments, a proposed layout of a wellbore (102) with an integrated double rail system (210). The double rail system (210) is comprised of a plurality of double rail sections (212) fitted end to end that may be of a head, web, and foot design, and constructed from steel alloy or equivalent. Extending from the surface (114) to the distal end of the wellbore (102), the double rail system (210) is connected to the internal surface of the casing (116). In addition, the double rail system (210) provides a physical track that attaches to, and guides, the single track logging tool carrier (310) from surface (114) to the bottom location of the wellbore (102). In one or more embodiments, the double rail system (210) may be disposed to the outside diameter of the casing (116) or pipeline (not shown).

Figure 3B:
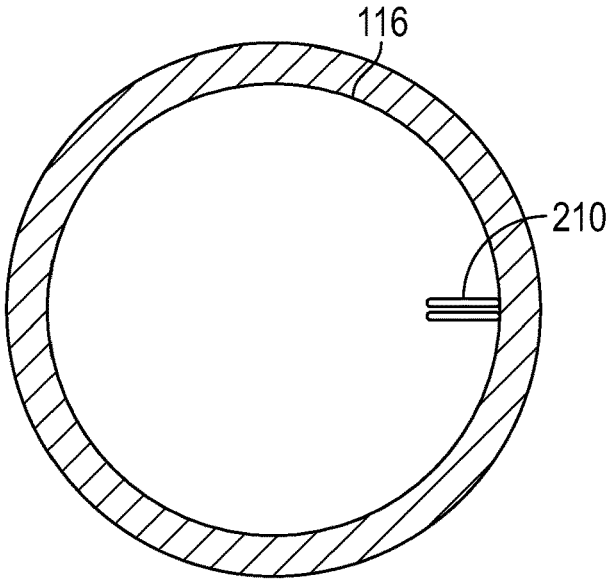
FIG. 3B is a schematic showing top view the Double Rail Track System in accordance with one or more embodiments.

FIG. 3B depicts, in one or more embodiments, the top view of the wellbore (102) from FIG. 3A with the double rail system (210) mounted to the internal surface of the casing (116). Again, those skilled in the art will appreciate that in other embodiments the single rail system (210) may be attached to the outside of the casing (116).

Figure 3C:
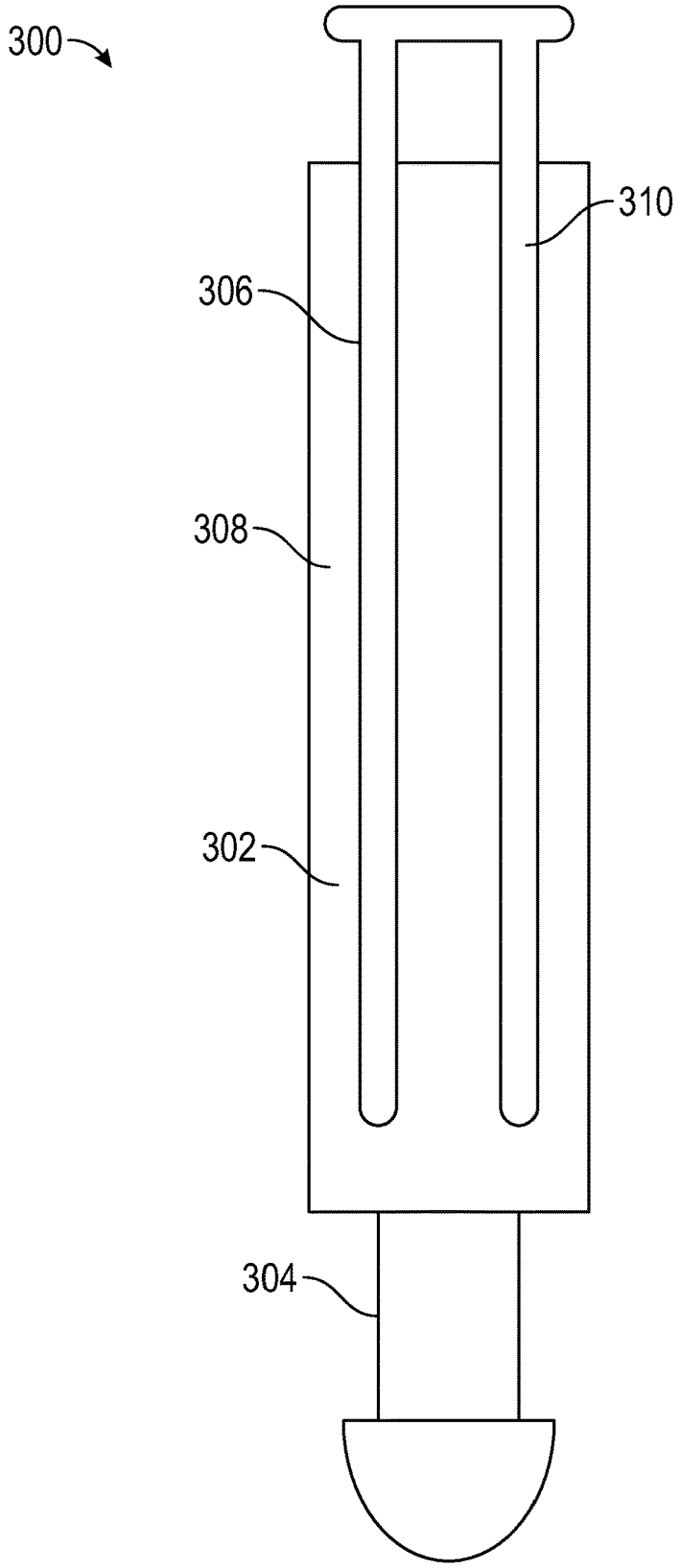
FIG. 3C is a schematic showing the Double Rail Track System Logging Tool in accordance with one or more embodiments.

Similarly, FIG. 3C depicts a logging tool (302), however, in this embodiment, the logging tool (302) is attached to double rail logging tool carrier (310). The logging tool (302) is the same as described in FIG. 2C. Therefore, the logging tool (302) attaches to the double rail logging tool carrier (310) in the same manner as the single rail logging tool carrier (300) and is constructed from the same non-corrosive material. In this embodiment the double rail logging tool carrier (310) is mounted to the double rail system (210) and configured to operatively traverse the wellbore (102) as required.

Figure 4B:
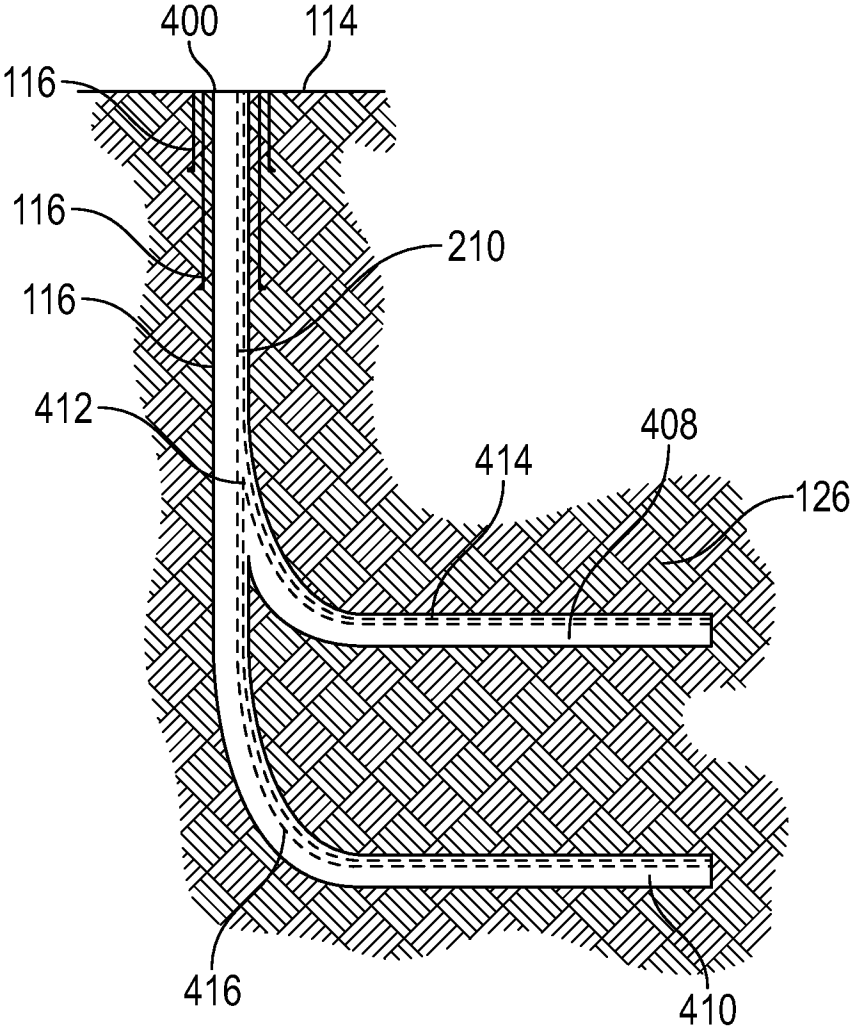
FIG. 4B is a schematic showing the Double Rail Track System integrated into a Multi-Lateral Wellbore in accordance with one or more embodiments.
Figure 4A:
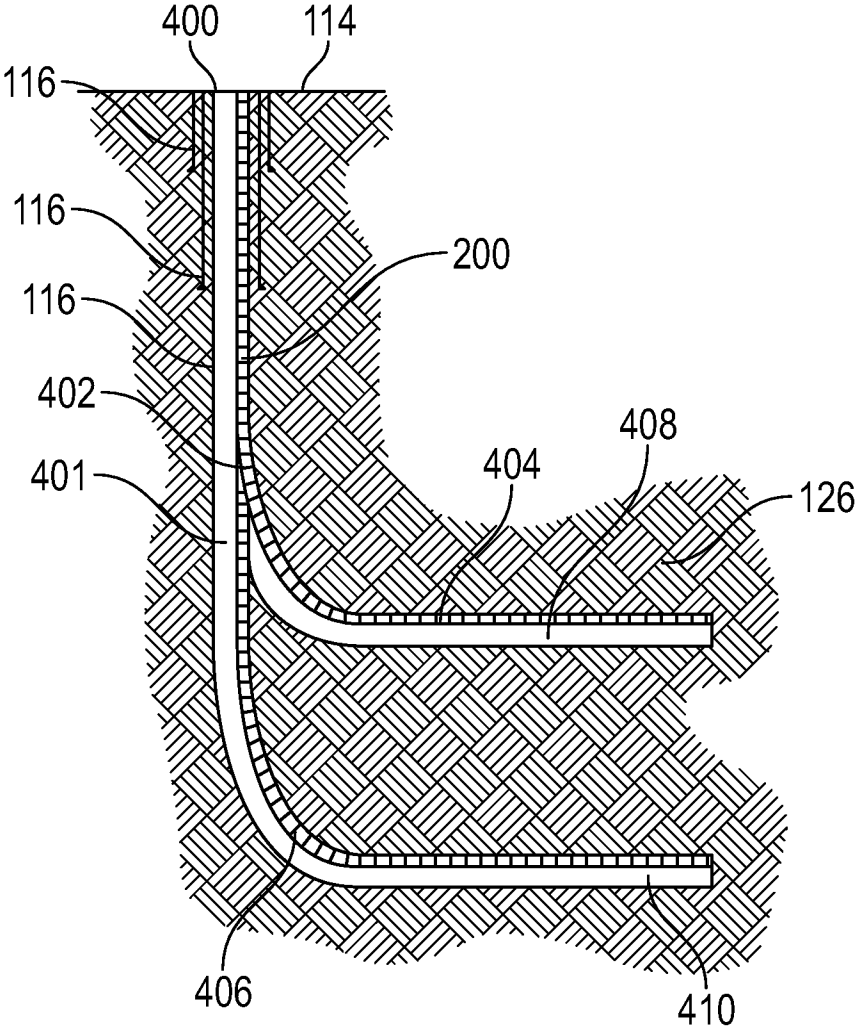
FIG. 4A is a schematic showing the Single Rail Track System integrated into a Multi-Lateral Wellbore in accordance with one or more embodiments.

FIG. 4A depicts, in one or more embodiments, a multi-lateral wellbore (400) with an integrated single rail system (200). In this embodiment, the single rail system (200) extends from surface (114) to the single rail junction (402), wherein the single rail system (200) divides into two sections, the single rail first section (404) and the single rail second section (406). The single rail first section (404) further extends into distal end of the first lateral (408) and the single rail second section (406) further extends into the distal end of the second lateral (410). As described above, the functionality of the single rail system (200) as a guide for the single rail logging tool carrier (300) to traverse the wellbore (102) is the same. However, in this example, the multi-lateral wellbore (400) is comprised of two laterals, which creates a single wellbore junction (401). The single rail logging tool carrier (300) is capable of navigating the single rail junction (402) and traversing both the first lateral (408) and the second lateral (410). FIG. 4B depicts, in one or more embodiments, a multi-lateral wellbore (400) with an integrated double rail system (210). In this embodiment, the double rail system (210) extends from surface (114) to the double rail junction (412), wherein the double rail system (210) divides into two sections, the double rail first section (414) and the double rail second section (416). The double rail first section (414) further extends into distal end of the first lateral (408) and the double rail second section (416) further extends into the distal end of the second lateral (410). As described above, the functionality of the double rail system (210) as a guide for the logging tool (302) to complete wellbore logging is the same. However, in this example, the multi-lateral wellbore (400) is comprised of two laterals, which creates a single wellbore junction (401). The double rail logging tool carrier (310) is capable of navigating the double rail junction (412) and traversing both the first lateral (408) and the second lateral (410).

In one or more embodiments, in a multi-lateral wellbore (400), or a wellbore (102) with a complex trajectory, there may be at least one permanently installed logging tool (not shown) and logging tool carrier (not shown) permanently installed on each of the first lateral (408) and the second lateral (410). As a non-limiting example, during logging operations, the logging tool (302) may be deployed from surface (114) and logs the wellbore (401) from the surface (114) to the wellbore junction (401). When the logging tool (302) reaches the wellbore junction (401) and is in close proximity to the permanently installed logging tool (not shown), the logging tool (302) activates the permanently installed logging tool (not shown). The permanently installed logging tool (not shown) will log the entire lateral section and return to the position at the wellbore junction (401). At this point, the permanently installed logging tool (not shown) will transfer the logging data back to the logging tool (302) while receiving a recharge of the power supply. Once this is complete, the logging tool (302) returns to the surface (114) and is removed from the wellbore (401).

Figure 5B:
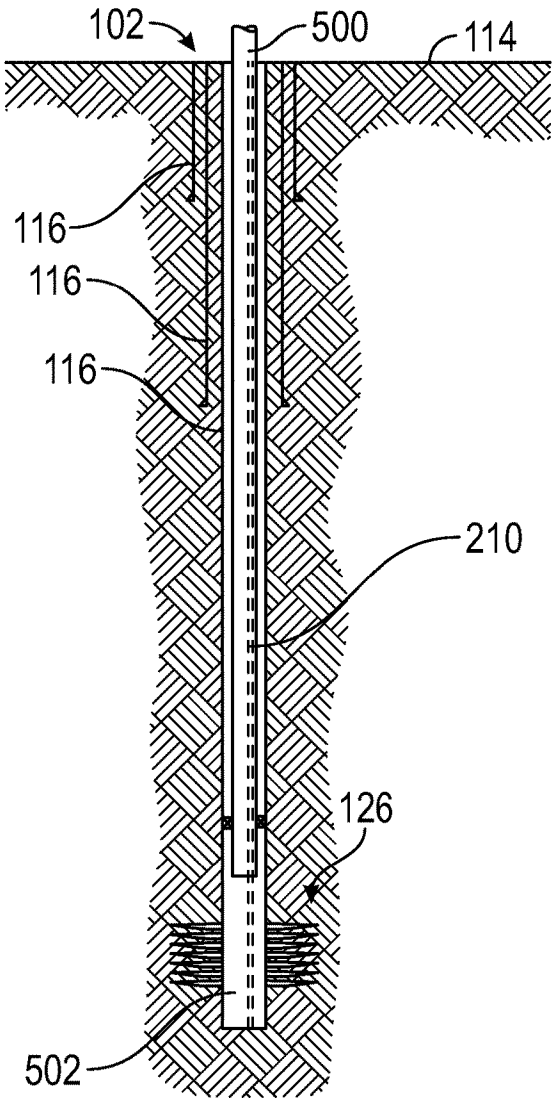
FIG. 5B is a schematic showing the Double Rail Track System in integrated into the wellbore production tubing in accordance with one or more embodiments.
Figure 5A:
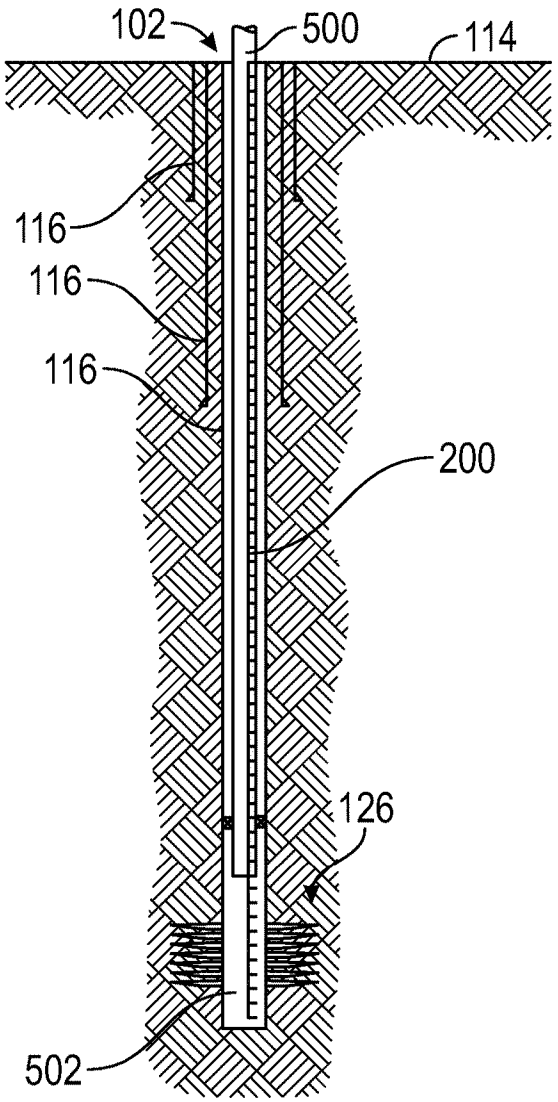
FIG. 5A is a schematic showing the Single Rail Track System in integrated into the wellbore production tubing in accordance with one or more embodiments.

FIG. 5A depicts, in one or more embodiments, a wellbore (102) and production tubing (500), with a single rail system (200) integrated into the production tubing (500). In this embodiment, the single rail system (200) extends from the surface (114) past the distal end of the production tubing (500) and into the open section (502). In other embodiments, the single rail system (200) may terminate and the distal end of the production tubing (500) with an electric line (not shown) extending into the open section (502). In this example, the single rail logging tool carrier (300), when deployed into the wellbore (102), will transfer from the single rail system (200) to the electric line (not shown). Those skilled in the art will appreciate that, as used herein, "open section" refers to any section of the tubular in which there is no rail system installed. Any point at which a section of tubular having the rail system and an open section of the tubular meet is referred to herein as a "transfer point." Alternatively, in one or more embodiments, it may be an end of the tubular and the transfer point allows the logging to depart the tubular all together.

Upon completing the logging of the wellbore (102) section between the production tubing (500) and the open section (502), the single rail logging tool carrier (300) will be pulled back to the interface between the single track rail system (200) and the electric line (not shown). The single rail logging tool carrier (300) will align with the single rail system (200), via a physical alignment guide or magnetic alignment guide, and transfer onto the single rail system (200) where the single rail logging tool carrier (300) will continue to be pulled out of the wellbore (102) and retrieved at surface (114).

Similar to FIG. 5A, FIG. 5B depicts a wellbore (102) and production tubing (500). However, in this embodiment a double rail system (210) is integrated into the production tubing (500). The double rail system (210) extends from the surface (114) past the distal end of the production tubing (500) and into the open section (502). In other embodiments, the double rail system (210) may terminate and the distal end of the production tubing (500) with an electric line (not shown) extending into the open section (502). In this example, the double rail logging tool carrier (310), when deployed into the wellbore (102), will transfer from the double rail system (210) to the electric line (not shown). Upon completing the logging of the wellbore (102) section between the production tubing (500) and the open section (502), the double rail logging tool carrier (310) will be pulled back to the interface between the double track rail system (210) and the electric line (not shown). The double rail logging tool carrier (310) will align with the double rail system (210), via a physical alignment guide (not shown) or magnetic alignment guide (not shown), and transfer onto the double rail system (210) where the double rail logging tool carrier (310) will continue to be pulled out of the wellbore (102) and retrieved at surface (114).

Figure 6A:
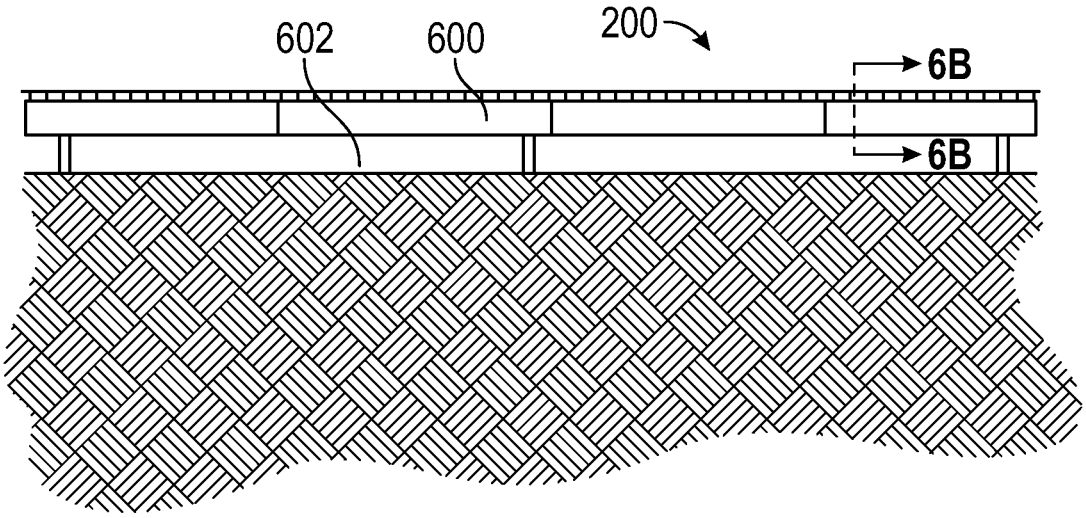
FIG. 6A is a schematic showing the Single Rail Track System in accordance with one or more embodiments.
Figure 6B:
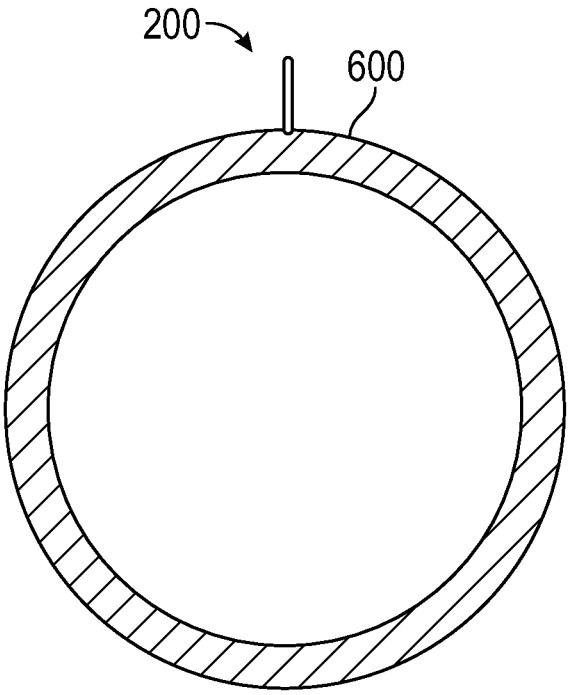
FIG. 6B is a schematic showing the cross section of the Single Rail Track System in accordance with one or more embodiments.

While the above embodiments are described with reference to a traditional "wellbore" drilled vertically from the earth's surface, deviated from vertical, or vertical to horizontal, in one or more embodiments, the same elements may be employed in other environments defined by a tubular without departing from the spirit of the invention. For instance, as shown in FIG. 6A and FIG. 6B, in one or more embodiments, the logging system may be used to acquire data from a surface pipeline (600). In this non-limiting example, the surface pipeline is located at or above the surface (602) with the single rail system (200) mounted to the outside surface of the surface pipeline (600). In other embodiments, the single rail system (300) may be a double rail system (300), or the single rail system may be mounted to the inside surface of the surface pipeline (600). Thus, without repeating the above descriptions in detail, those skilled in the art will readily appreciate that, in embodiments above the earth's surface "wellbore" may be equated to any drilling or pipeline "tubular."

Figure 7:
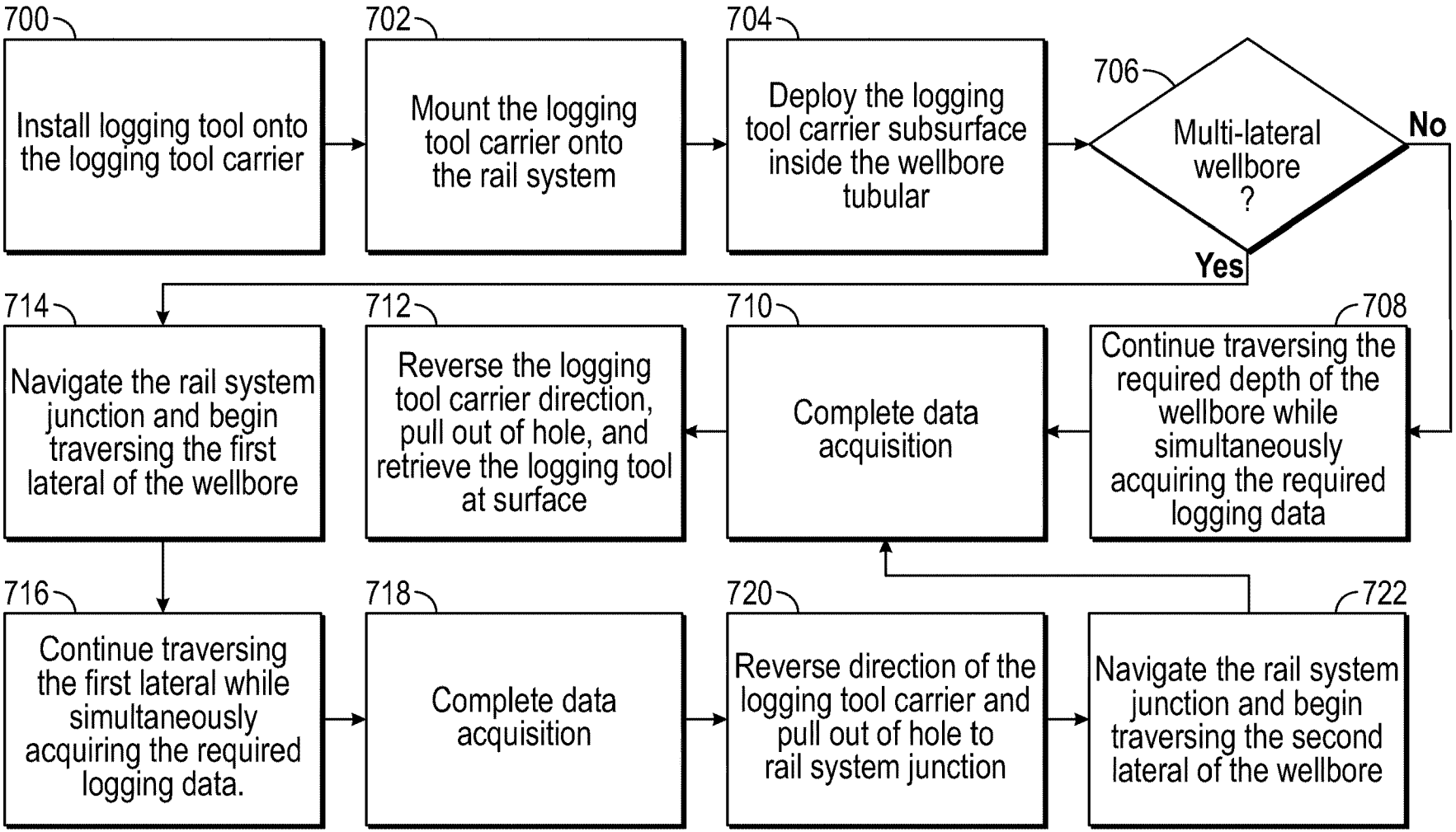
FIG. 7 is a flow chart in accordance with one or more embodiments.

FIG. 7 is a flow chart depicting, in one or more embodiments, the operational sequence of logging a wellbore (102) using either a single rail system (200) or a double rail system (210). In fact, the number of rails used in the rail system is not critical to the operation of the system and, in one or more embodiments, any number of rails may be employed. Accordingly, the following description of the flow chart will focus on the single rail system (200) but is equally applicable to a rail system including any plurality of rails. One or more blocks in FIG. 7 may be performed using one or more components as described in FIGS. 1 through 6. While the various blocks in FIG. 7 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

In Step 700, in one or more embodiments, the logging tool (302) is attached to the single rail logging tool carrier (300). This operation is completed at surface (114) before deploying the logging tool carrier (300) into the wellbore.

In Step 702, in one or more embodiments, the single rail logging tool carrier (300), with the attached logging tool (302), is mounted at surface (114) to the single rail system (200) that is connected to the internal surface of the casing (116). At this stage, all final inspections and electronics communications checks are completed, and the single rail logging tool carrier (300) is ready for deployment into the wellbore (102).

In Step 704, in one or more embodiments, the single rail logging tool carrier (300) is deployed into the wellbore (102) on the single rail system (200) inside the casing (116). The logging tool (302) is active and continuously measures the desired subsurface parameters as the single rail logging tool carrier (300) traversing downhole in the wellbore (102). In Step 706, in one or more embodiments, the wellbore (104) may consist of a multi-lateral wellbore (400). This is part of the wellbore (104) design, and the single rail system (200) may only extend into the first lateral (408) or the single rail system (200) may split creating a single rail junction (402), in which the single rail system (200) extends the length of the first lateral (408) and the second lateral (410). If a multi-lateral wellbore (400) is present the operation sequence would proceed to Step 714. Otherwise, the operation sequence would continue to Step 708.

In Step 708, in one or more embodiments, the is only one lateral in the wellbore (102) and the single rail logging tool carrier (300) continues to traverse the wellbore (102) collecting the desired subsurface data until the single rail logging tool carrier (300) reaches the distal end of the wellbore (102).

In Step 710, in one or more embodiments, the single rail logging tool carrier (300) has reached the bottom most point of the wellbore (102). However, in order to capture all the desired logging data, the logging tool (302) and single rail logging tool carrier (300) may need to perform multiple passes across specific portion of the wellbore (102). A non-limiting example might be that a specific section of the reservoir/formation (126) may be of interest. In this case the logging tool (302) and single rail logging tool carrier (300) may need to physically pass this section multiple times to acquire sufficiently accurate data.

In Step 712, in one or more embodiments, all required logging data has been collected and the logging tool (302) and single track logging tool carrier (300) reverse direction, are pulled out of the wellbore (102), and recovered at surface (114).

In Step 714, in one or more embodiments, the wellbore (102) is a multi-lateral wellbore (400). This means that the wellbore (102) splits into at least two lateral sections, a first lateral (408) and a second lateral (410). In some embodiments, the single rail system (200) is divided into two sections with each single rail system (200) extended to the distal end of both the first lateral (408) and the second later (410). In this scenario, the single rail logging tool carrier (300), when deployed inside the casing (116) with the logging tool (302), will navigate the single rail junction (402) and begin traversing the first lateral (408) of the multi-lateral wellbore (400).

In Step 716, in one or more embodiments, the single rail logging tool carrier (300) and logging tool (302) continue traversing the first lateral (408) while simultaneously collected the desired logging data. This operation continues until the single rail logging tool carrier (300) reaches the distal end of the first lateral (408) of the multi-lateral wellbore (400).

In Step 718, in one or more embodiments, the single rail logging tool carrier (300) has reached the bottom most point of the first lateral (408) of the multi-lateral wellbore (400). However, in order to capture all the desired logging data, the logging tool (302) and single rail logging tool carrier (300) may need to perform multiple passes across specific portion of the wellbore (102). A non-limiting example might be that a specific section of the reservoir/formation (126) may be of interest. In this case the logging tool (302) and single rail logging tool carrier (300) may need to physically pass this section multiple times to acquire sufficiently accurate data.

In Step 720, in one or more embodiments, the single rail logging tool carrier (300) and the logging tool (300) have completed the data acquisition operation and have been pulled out of hole to the single rail junction (402). In some embodiments, if the first lateral (408) was the extend of the required data collection, the single rail logging tool carrier (300) could be pulled out of hole to surface (114). However, if the data acquisition of the second lateral (410) is required, the single rail logging tool carrier (300) could navigate the single rail junction (402) and being traversing the second lateral (410) without first having to return to the surface (114).

In Step 722, in one or more embodiments, the single rail logging tool carrier (300) and logging tool (302) continue traversing the second lateral (410) while simultaneously collected the desired logging data. This operation continues until the single rail logging tool carrier (300) reaches the distal end of the second lateral (410) of the multi-lateral wellbore (400). At this stage, the operation moves to process Step 710 followed by Step 712, where the data acquisition is completed, and the single rail logging tool carrier (300) and the logging tool (300) is recovered at surface (114).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A logging system for a tubular, comprising:

a rail system comprising a plurality of rails and mounted to a surface of the tubular;

a logging tool carrier connected to the rail system; and a logging tool disposed on the logging tool carrier;

wherein the logging tool is deployed on the logging tool carrier connected to the rail system along the tubular to a targeted position along the tubular and then retrieved from a wellbore;

wherein, during deployment of the logging tool, the logging tool acquires a plurality of logging data; and wherein the rail system is configured to extend into an open section of the tubular.

2. The system of claim 1, wherein:

the surface of the tubular is an internal surface.

3. The system of claim 1, wherein:

the tubular is at least one of a wellbore, a casing, a casing liner, a production tubing, a flowline, or a pipeline.

4. The system of claim 1, wherein:

the rail system is configured as a single track.

5. The system of claim 1, wherein:

the rail system is configured with at least two tracks; and the logging tool carrier is configured to attach to each of the at least two tracks of the rail system.

6. The system of claim 1, wherein:

the logging tool comprises sensors capable of measuring and acquiring the plurality of logging data;

wherein the logging tool has a front end and a back end, wherein the front end enters the wellbore before the back end upon deployment of the logging tool into the wellbore, wherein the sensors are located at a position near the front of the logging tool carrier.

7. The system of claim 1, wherein:

the logging tool carrier comprises a power source;

wherein the power source is a battery located at a position near the back of the logging tool carrier.

8. The system of claim 7, wherein:

the logging tool carrier comprises an inlet fan;

wherein the inlet fan is located at a position near at least one of the front and the back of the logging tool carrier.

9. The system of claim 1, wherein:

the tubular has a trajectory that is at least one of a vertical, a deviated, a horizontal, short radius, or an undulating trajectory.

10. The system of claim 1, wherein:

the logging tool carrier is formed from a non-corrosive material;

whereby the logging tool is adapted to operate in hazardous environments including gas, liquid, and corrosive conditions.

11. The system of claim 1, wherein:

the rail system is configured to transfer the logging tool carrier to an electric line at a transfer point along the tubular;

wherein the electric line is capable of conveying the logging tool carrier along the open section and returning the logging tool carrier to the transfer point of the tubular, wherein the logging tool carrier is transferred back onto the rail system.

12. The system of claim 11, wherein:

the logging tool carried is aligned and transferred from the electric line to the rail system using a magnetic alignment element.

13. A logging system of for a tubular, comprising:

a rail system comprising a plurality of rails and mounted to a surface of the tubular;

a logging tool carrier connected to the rail system; and a logging tool disposed on the logging tool carrier;

wherein the logging tool is deployed on the logging tool carrier connected to the rail system along the tubular to a targeted position along the tubular and then retrieved from a wellbore;

wherein, during deployment of the logging tool, the logging tool acquires a plurality of logging data;

the tubular comprising an electronic submersible pump (ESP), and the tubular being configured with a bypass or a diverter system to allow for the rail system and the logging tool to pass the ESP within the tubular.

14. A logging system for a tubular, comprising:

a rail system comprising a plurality of rails and mounted to a surface of the tubular;

a logging tool carrier connected to the rail system; and a logging tool disposed on the logging tool carrier;

wherein the logging tool is deployed on the logging tool carrier connected to the rail system along the tubular to a targeted position along the tubular and then retrieved from a wellbore;

wherein, during deployment of the logging tool, the logging tool acquires a plurality of logging data;

the wellbore being a multi-lateral wellbore and configured with at least a first lateral and a second lateral; and the rail system being configured to span each of the first lateral and the second lateral;

wherein the logging tool can be conveyed on the rail system in each of the first lateral and the second lateral of the multi-lateral wellbore.

15. The logging tool of claim 14, wherein:

there is at least one of the logging tools permanently disposed on the rail system in each of the first lateral and the second lateral of the tubular and configured to operatively log the respective laterals.

16. A method of logging a tubular, comprising:

mounting a rail system within an inside diameter surface of a tubular;

disposing a logging tool onto a logging tool carrier, connecting the logging tool carrier to the rail system;

deploying the logging tool carrier from a deployment position on the rail system inside the tubular, wherein the rail system guides the logging tool carrier to a targeted point along the tubular;

retrieving the logging tool carrier via the rail system along the tubular, wherein rail system guides the return of the logging tool carrier to the deployment position;

acquiring, via the logging tool while deployed, a plurality of logging data; and configuring the rail system to transfer the logging tool carrier to an electric line at a transfer point of the tubular;

wherein the rail system extends into an open section of the tubular; and wherein the electric line is capable of conveying the logging tool carrier along the open section and returning the logging tool carrier to the transfer point of the tubular, where the logging tool carrier is transferred back onto the rail system.

17. The method of claim 16 further comprising:

configuring the rail system as a single track.

18. The method of claim 16 further comprising:

configuring the rail system with at least two tracks, and configuring the logging tool carrier to attach to each of the at least two tracks of the rail system.

* * * * *